US009685129B2

(12) United States Patent
Sone et al.

(10) Patent No.: US 9,685,129 B2
(45) Date of Patent: Jun. 20, 2017

(54) LIQUID CRYSTAL DISPLAY DEVICE

(71) Applicant: Sharp Kabushiki Kaisha, Osaka-shi, Osaka (JP)

(72) Inventors: Takuya Sone, Osaka (JP); Noriyuki Tanaka, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/786,202

(22) PCT Filed: Feb. 25, 2014

(86) PCT No.: PCT/JP2014/054553

§ 371 (c)(1),
(2) Date: Oct. 22, 2015

(87) PCT Pub. No.: WO2014/174888

PCT Pub. Date: Oct. 30, 2014

(65) Prior Publication Data

US 2016/0078831 A1 Mar. 17, 2016

(30) Foreign Application Priority Data

Apr. 23, 2013 (JP) ..... 2013-090714

(51) Int. Cl.

| | |
|---|---|
| ***G09G 3/36*** | (2006.01) |
| ***G09G 5/00*** | (2006.01) |
| ***G09G 5/18*** | (2006.01) |

(52) U.S. Cl.

CPC ..... *G09G 3/3648* (2013.01); *G09G 3/3611* (2013.01); *G09G 3/3696* (2013.01);
(Continued)

(58) Field of Classification Search

CPC ..... G09G 2230/00; G09G 2310/08; G09G 2330/021; G09G 2330/04; G09G 2330/08;

(Continued)

(56) References Cited

U.S. PATENT DOCUMENTS

2002/0093473 A1 7/2002 Tanaka et al.
2002/0126114 A1* 9/2002 Yatabe ..... G09G 3/367 345/212

(Continued)

FOREIGN PATENT DOCUMENTS

JP 2000-347762 A 12/2000
JP 2001-312253 A 11/2001

(Continued)

*Primary Examiner* — Hong Zhou
(74) *Attorney, Agent, or Firm* — Keating & Bennett, LLP

(57) ABSTRACT

A scanning line drive unit sequentially selects a plurality of scanning lines, and utilizes a drive voltage generated by the booster circuit to control the operation of a thin-film transistor. A timing control unit controls the scanning line drive unit on the basis of a display signal, which includes a horizontal synchronization signal, a vertical synchronization signal and an image signal. A reference synchronization signal is input to the booster circuit during a period in which the scanning line drive unit selects none of the plurality of scanning lines. A booster circuit generates a non-selection voltage in synchronization with the reference synchronization signal in the abovementioned period. The scanning line drive unit outputs the non-selection voltage generated by the booster circuit to the plurality of scanning lines in the abovementioned period.

10 Claims, 9 Drawing Sheets

(52) U.S. Cl.
CPC ..... *G09G 5/006* (2013.01); *G09G 5/18* (2013.01); *G09G 3/3677* (2013.01); *G09G 2230/00* (2013.01); *G09G 2310/08* (2013.01); *G09G 2330/021* (2013.01); *G09G 2330/04* (2013.01); *G09G 2330/08* (2013.01)

(58) Field of Classification Search
CPC .. G09G 3/3611; G09G 3/3648; G09G 3/3677; G09G 3/3696; G09G 5/006; G09G 5/18
USPC ..... 345/87–102, 204–212
See application file for complete search history.

(56) References Cited

U.S. PATENT DOCUMENTS

2002/0180673 A1 12/2002 Tsuda et al.
2004/0036669 A1 2/2004 Yanagi et al.
2004/0095342 A1* 5/2004 Lee ..... G09G 3/3696 345/211
2004/0113879 A1* 6/2004 Sekiguchi ..... G09G 3/3648 345/94
2007/0263122 A1* 11/2007 Araki ..... G09G 5/008 348/536
2008/0111840 A1* 5/2008 Tsuchi ..... G09G 3/3685 345/690
2011/0115834 A1* 5/2011 Han ..... H02M 3/073 345/691
2011/0157128 A1* 6/2011 Koyama ..... G09G 3/3648 345/211
2011/0157253 A1* 6/2011 Yamazaki ..... G02F 1/133555 345/690
2012/0032942 A1 2/2012 Toyotaka et al.
2012/0138922 A1 6/2012 Yamazaki et al.
2013/0135282 A1* 5/2013 Jeon ..... G09G 3/3696 345/212
2014/0022231 A1 1/2014 Saitoh et al.

FOREIGN PATENT DOCUMENTS

JP 2002-278523 A 9/2002
JP 2004-078124 A 3/2004
JP 2005-037685 A 2/2005
JP 2006-215087 A 8/2006
JP 2007-219155 A 8/2007
JP 2012-053454 A 3/2012
JP 2012-134475 A 7/2012
WO 2012/137761 A1 10/2012

* cited by examiner

LIQUID CRYSTAL DISPLAY DEVICE

TECHNICAL FIELD

The present invention relates to a liquid crystal display device.

BACKGROUND ART

A liquid crystal display device in which an image is displayed on a liquid crystal panel has been known conventionally. In the liquid crystal display device, images are displayed on the liquid crystal panel, based on display signals (including vertical synchronization signals, horizontal synchronization signals and image signals) sent from a host to a timing controller.

In recent years, in a liquid crystal display device, it is required to reduce electric power consumption. One of driving methods that reduce electric power consumption of a liquid crystal display device is a driving method called "pausing driving".

In the pausing driving, a driving period and a pausing period are alternately repeated. Here, the driving period refers to a period in which a plurality of scanning lines are selected and scanned in order, and signal voltages are written. The pausing period refers to a period in which all of the scanning lines are caused to assume a non-selection state and the writing of signal voltages is suspended. In the pausing driving, since there is a period in which the writing of signal voltages is suspended, electric power consumption can be reduced. Such a pausing driving is disclosed in, for example, JP2001-312253A.

DISCLOSURE OF THE INVENTION

Due to the reduction of electric power consumption, however, it possibly becomes difficult to secure the quality of images displayed on the liquid crystal panel, that is, the display quality of the liquid crystal panel. This is because without the writing of signal voltages, images deteriorate due to leakage current of thin film transistors, which makes it difficult to secure the display quality of the liquid crystal panel. To secure the display quality of a liquid crystal pane is likewise requested also in the case where the reduction of electric power consumption is not attempted.

An object of the present invention is to provide a liquid crystal display device in which display quality of a liquid crystal panel can be secured.

A liquid crystal display device according to an embodiment of the present invention includes a liquid crystal panel and displays images on the liquid crystal panel. The liquid crystal panel includes a plurality of scanning lines, a plurality of signal lines, and thin film transistors. The plurality of signal lines intersect with the plurality of scanning lines. The thin film transistors are provided at points of intersection of the plurality of scanning lines and the plurality of signal lines, respectively, and are connected to pixel electrodes. The liquid crystal display device further includes: a booster circuit, a scanning line drive unit, and a timing control unit. The booster circuit generates a driving voltage from a power source voltage. The scanning line drive unit selects the plurality of scanning lines in order and controls operations of the thin film transistors using the driving voltage generated by the booster circuit. The timing control unit controls the scanning line drive unit based on a display signal that includes a horizontal synchronization signal, a vertical synchronization signal, and an image signal. The driving voltage includes a selection voltage and a non-selection voltage. The selection voltage is output to, among the plurality of scanning lines, one selected by the scanning line drive unit. The non-selection voltage has a polarity opposite to that of the selection voltage. To the booster circuit, the reference synchronization signal is input, during a period while the scanning line drive unit selects none of the plurality of scanning lines. The booster circuit, during the period, generates the non-selection voltage in synchronization with the reference synchronization signal. The scanning line drive unit, during the period, outputs the non-selection voltage generated by the booster circuit to the plurality of scanning lines.

In the liquid crystal display device according to the embodiment of the present invention, the display quality of the liquid crystal panel can be secured.

EMBODIMENTS FOR CARRYING OUT THE INVENTION

Figure 1:
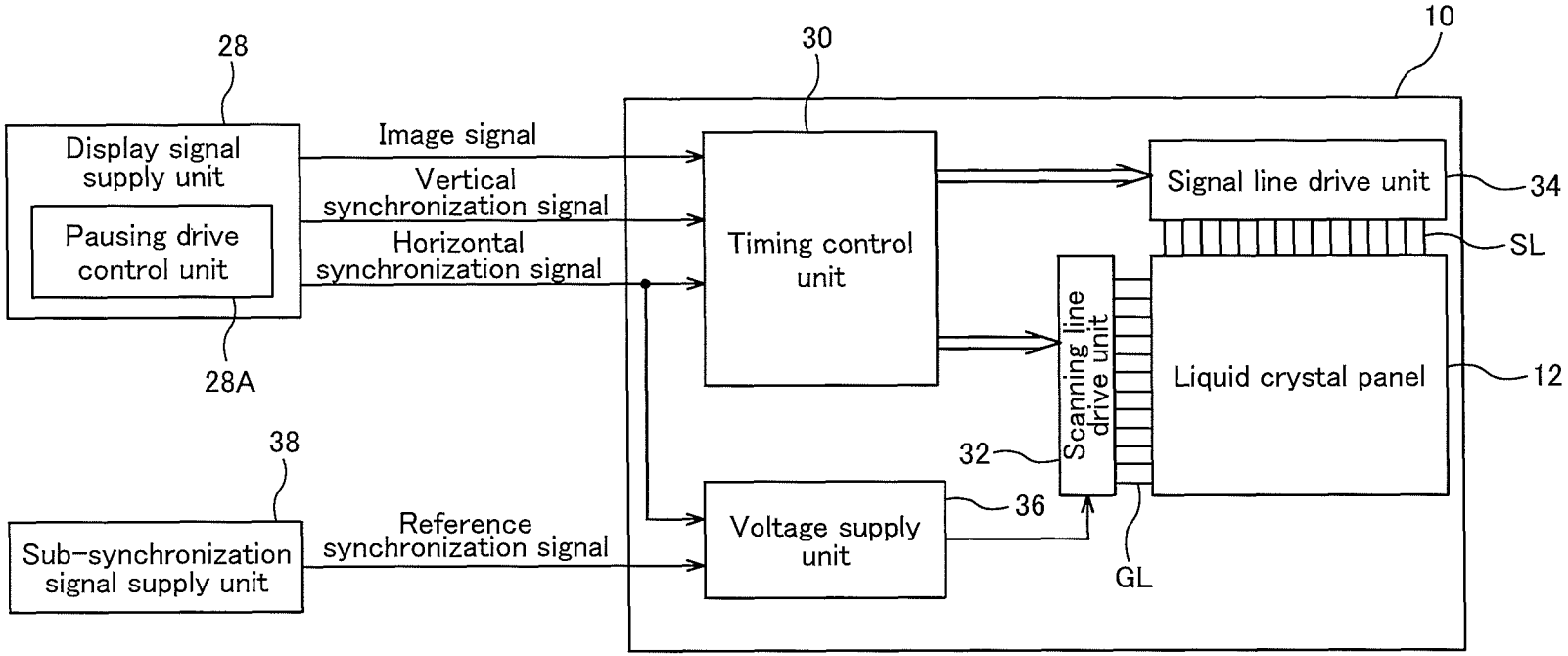
FIG. 1 is a block diagram illustrating a schematic configuration of a liquid crystal display device according to the First Embodiment of the present invention.

A liquid crystal display device according to a first aspect of the present invention includes a liquid crystal panel, and displays images on the liquid crystal panel. The liquid crystal panel includes a plurality of scanning lines, a plurality of signal lines, and thin film transistors. The plurality of signal lines intersect with the plurality of scanning lines. The thin film transistors are provided at points of intersection of the plurality of scanning lines and the plurality of signal lines, respectively, and are connected to pixel electrodes. The liquid crystal display device further includes: a booster circuit, a scanning line drive unit, and a timing control unit. The booster circuit generates a driving voltage from a power source voltage. The scanning line drive unit selects the plurality of scanning lines in order and controls operations of the thin film transistors using the driving voltage generated by the booster circuit. The timing control unit controls the scanning line drive unit based on a display signal that includes a horizontal synchronization signal, a vertical synchronization signal, and an image signal. The driving voltage includes a selection voltage and a non-selection voltage. The selection voltage is output to, among the plurality of scanning lines, one selected by the scanning line drive unit. The non-selection voltage has a polarity opposite to that of the selection voltage. To the booster circuit, the reference synchronization signal is input, during a period while the scanning line drive unit selects none of the plurality of scanning lines. The booster circuit, during the period, generates the non-selection voltage in synchronization with the reference synchronization signal. The scanning line drive unit, during the period, outputs the non-selection voltage generated by the booster circuit to the plurality of scanning lines.

In the liquid crystal display device according to the first aspect, the reference synchronization signal is input to the booster circuit, during a period while the scanning line drive unit selects none of the plurality of scanning lines. This causes the non-selection voltage supplied to the scanning line drive unit to be generated even during the above-described period. Here, the non-selection voltage has a polarity opposite to that of the selection voltage. Therefore, this makes it possible to reduce the leakage current of the thin film transistors. Therefore, in the liquid crystal display device according to the first aspect, deterioration of images during a period while the scanning line drive unit selects none of the plurality of scanning lines, that is, deterioration of images due to leakage current of the thin film transistors, can be suppressed. Consequently, the display quality of the liquid crystal panel can be secured.

A liquid crystal display device according to a second aspect of the present invention is the liquid crystal display device according to the first aspect configured so that the timing control unit alternately realizes a driving period and a pausing period. The driving period is a period while control of the scanning line drive unit based on the display signal is carried out. The pausing period is a period while control of the scanning line drive unit based on the display signal is suspended. To the booster circuit, the reference synchronization signal is input, at least during the pausing period. The booster circuit, during the pausing period, generates the non-selection voltage in synchronization with the reference synchronization signal. The scanning line drive unit, during the pausing period, outputs the non-selection voltage generated by the booster circuit to the plurality of scanning lines.

In the liquid crystal display device according to the second aspect, the driving period and the pausing period are alternately realized. Therefore, electric power consumption can be reduced.

A liquid crystal display device according to a third aspect of the present invention is the liquid crystal display device according to the second aspect configured so that, to the booster circuit, the horizontal synchronization signal is further input. The booster circuit, during the driving period, generates the selection voltage and the non-selection voltage in synchronization with the horizontal synchronization signal.

In the liquid crystal display device according to the third aspect, in images displayed on the liquid crystal panel, noises become inconspicuous. Consequently, the display quality of the liquid crystal panel can be secured.

A liquid crystal display device according to a fourth aspect of the present invention is the liquid crystal display device according to the third aspect configured so as to further include a counter. The counter increments the counter value every time when the sub-synchronization signal input, and resets the counter value every time when the horizontal synchronization signal is input.

A liquid crystal display device according to a fifth aspect of the present invention is the liquid crystal display device according to the second aspect configured so that, to the booster circuit, the reference synchronization signal is input during each of the driving period and the pausing period. The booster circuit, during the driving period, generates the selection voltage and the non-selection voltage in synchronization with the reference synchronization signal.

In the liquid crystal display device according to the fifth aspect, it is unnecessary to make the synchronization signal for generating the driving voltage different between the driving period and the pausing period. Therefore, as compared with the case where the synchronization signal for generating the driving voltage has to be made different between the driving period and the pausing period, the configuration is simplified.

A liquid crystal display device according to a sixth aspect of the present invention is the liquid crystal display device according to any one of the first to fifth aspects configured so that the display signal sent thereto as a parallel signal is input to the timing control unit.

A liquid crystal display device according to a seventh aspect of the present invention is the liquid crystal display device according to the sixth aspect configured so as to further include an interface. The interface converts the display signal sent thereto as a differential serial signal into a parallel signal, and outputs the same to the timing control unit.

In the liquid crystal display device according to the seventh aspect, the display signal can be transferred at a high speed, as compared with the case where the display signal is sent as a parallel signal.

A liquid crystal display device according to an eighth aspect of the present invention is the liquid crystal display device according to any one of the first to seventh aspects configured so that the thin film transistor has a semiconductor layer made of an oxide semiconductor.

A liquid crystal display device according to a ninth aspect of the present invention is the liquid crystal display device according to the eighth aspect configured so that the oxide semiconductor contains indium (In), gallium (Ga), zinc (Zn) and oxygen (O).

In the liquid crystal display device according to the ninth aspect, leakage current can be reduced as compared with the case where the semiconductor layer is made of silicon.

A liquid crystal display device according to a tenth aspect of the present invention is the liquid crystal display device according to the ninth aspect configured so that the oxide semiconductor has crystallinity.

The following describes more specific embodiments of the present invention while referring to the drawings. In the drawings, identical or equivalent parts are denoted by the same reference numerals, and descriptions of the same are not repeated.

The First Embodiment

FIG. 1 is a block diagram illustrating a liquid crystal display device 10 according to the First Embodiment of the present invention. The liquid crystal display device 10 is used for displaying images in, for example, a mobile device such as a smartphone and a tablet, a mobile phone, a television receiver, or a notebook computer. The liquid crystal display device 10 includes a liquid crystal panel 12, a timing control unit 30, a scanning line drive unit 32, a signal line drive unit 34, and a voltage supply unit 36.

Figure 2:
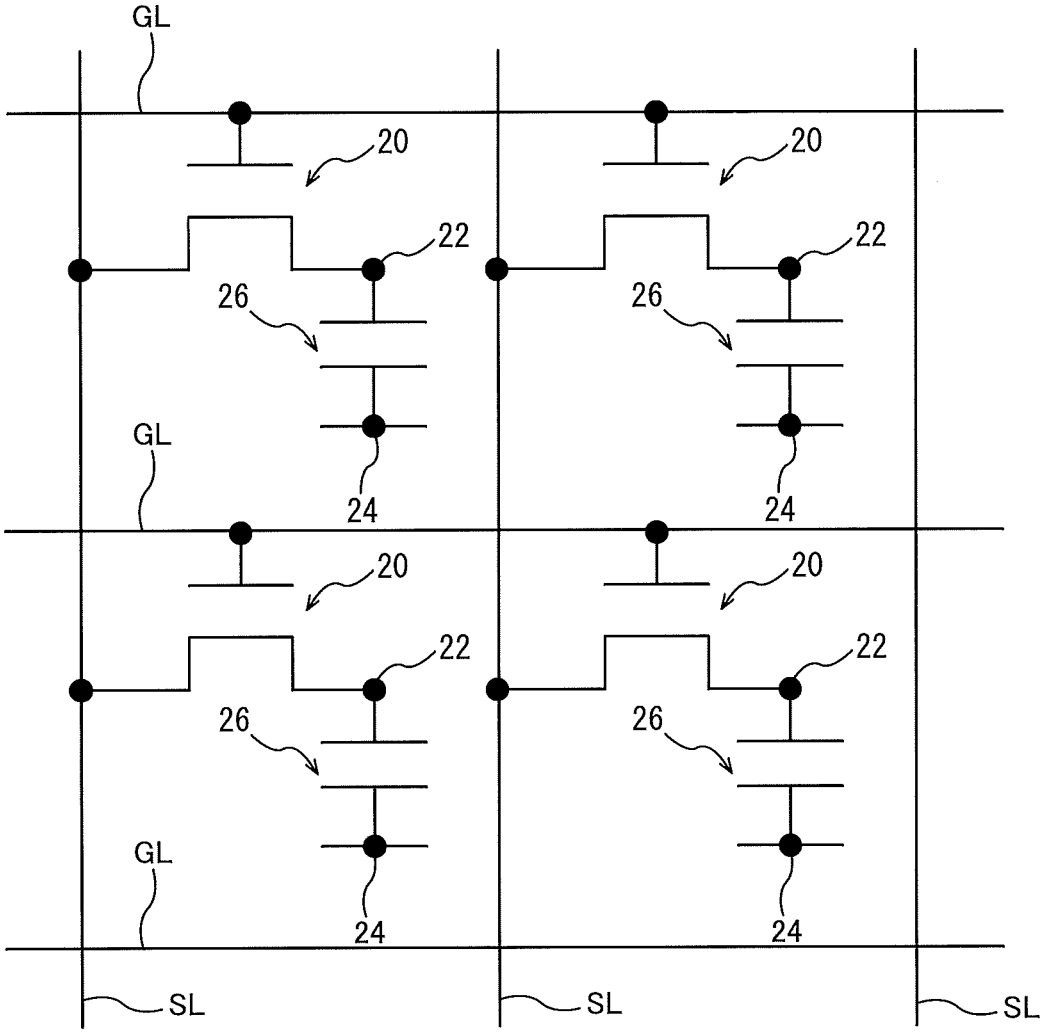
FIG. 2 is an equivalent circuit diagram for explaining pixels of a liquid crystal panel provided in the liquid crystal display device illustrated in FIG. 1.

The following describes the liquid crystal panel 12, while referring to FIG. 2. The liquid crystal panel 12 includes a plurality of scanning lines GL and a plurality of signal lines SL. The plurality of signal lines SL intersect with the plurality of scanning lines GL. A thin film transistor 20 as a switching element is provided at each of points of intersection of the scanning lines GL and the signal lines SL. Here, the phrase of "a thin film transistor 20 is provided at each of intersections of the scanning lines GL and the signal lines SL" also encompasses the case where a thin film transistor 20 is provided in the vicinities of a point of intersection of the scanning line GL and the signal line SL.

In the thin film transistor 20, a gate electrode is connected to the scanning line GL, a source electrode is connected to the signal line SL, and a drain electrode is connected to a pixel electrode 22. A common electrode 24 is provided so as to face the pixel electrode 22. Between the pixel electrode 22 and the common electrode 24, there is provided a liquid crystal layer. The pixel electrode 22, the common electrode 24, and the liquid crystal layer form an accumulation capacitor 26. Charges corresponding to a signal voltage written via the signal line SL and the thin film transistor 20 are accumulated in the accumulation capacitor 26, whereby a desired image is displayed on the liquid crystal panel 12.

The thin film transistor 20 may include a semiconductor layer made of silicon, but preferably includes a semiconductor layer made of an oxide semiconductor.

The oxide semiconductor contains, for example, an In—Ga—Zn—O-based semiconductor. Here, the In—Ga—Zn—O-based semiconductor is a ternary oxide of In (indium), Ga (gallium), and Zn (zinc), and the ratio of In, Ga, and Zn (composition ratio) is not limited particularly, and examples of the ratio include In:Ga:Zn=2:2:1, In:Ga:Zn=1:1:1, and In:Ga:Zn=1:1:2. In the present embodiment, the thin film transistor 20 includes an In—Ga—Zn—O-based semiconductor layer that contains In, Ga, and Zn at a ratio of 1:1:1.

Since the TFT including the In—Ga—Zn—O-based semiconductor layer has a high mobility (20 times or greater as compared with a-SiTFT) and a low leakage current (less than one hundredth as compared with a-SiTFT), such a TFT can be suitably used as a driving TFT and as a pixel TFT. Using the TFT having the In—Ga—Zn—O-based semiconductor layer makes it possible to significantly reduce electric power consumption of the liquid crystal display device 10.

The In—Ga—Zn—O-based semiconductor may be amorphous, or may include a crystalline-substance part thereby having crystallinity. As the crystalline In—Ga—Zn—O-based semiconductor, a crystalline In—Ga—Zn—O-based semiconductor having the c-axis aligned approximately in a perpendicular direction with respect to the layer surface is preferable. The crystal structure of such an In—Ga—Zn—O-based semiconductor is disclosed by, for example, JP2012-134475A. An entirety of contents disclosed in JP2012-134475A is incorporated herein for reference.

The oxide semiconductor may be an oxide semiconductor other than the In—Ga—Zn—O-based semiconductor. For example, the oxide semiconductor may be a Zn—O-based semiconductor (ZnO), an In—Z—O-based semiconductor (IZO (registered trademark)), a Zn—Ti—O-based semiconductor (ZTO), a Cd—Ge—O-based semiconductor, a Cd—Pb—O-based semiconductor, CdO (cadmium oxide), a Mg—Zn—O-based semiconductor, an In—Sn—Zn—O-based semiconductor (for example, $In_2O_3$—$SnO_2$—ZnO), or an In—Ga—Sn—O-based semiconductor.

Again, the following description is made with reference to FIG. 1. To the liquid crystal display device 10, a display signal is sent from the display signal supply unit 28. Here, the display signal includes a horizontal synchronization signal, a vertical synchronization signal, and an image signal. The display signal supply unit 28 outputs a display signal as a parallel signal to the timing control unit 30.

The timing control unit 30 controls the scanning line drive unit 32 and the signal line drive unit 34 based on the display signal sent from the display signal supply unit 28.

The scanning line drive unit 32 is a gate driver. The scanning line drive unit 32 is connected to the plurality of scanning lines GL. The scanning line drive unit 32 selects and scans the plurality of scanning lines GL in order based on a control signal sent from the timing control unit 30, so as to control operations of the thin film transistors 20.

The signal line drive unit 34 is a source driver. The signal line drive unit 34 is connected to the plurality of signal lines SL. The signal line drive unit 34 outputs a signal voltage to the plurality of signal lines SL based on the control signal sent from the timing control unit 30.

The voltage supply unit 36 generates a voltage necessary for controlling operations of the liquid crystal panel 12. The following describes the voltage supply unit 36 while referring to FIG. 3. The voltage supply unit 36 includes a counter 44, a comparator circuit 46, a register 48, a selection unit 50, and a booster circuit 52.

Figure 3:
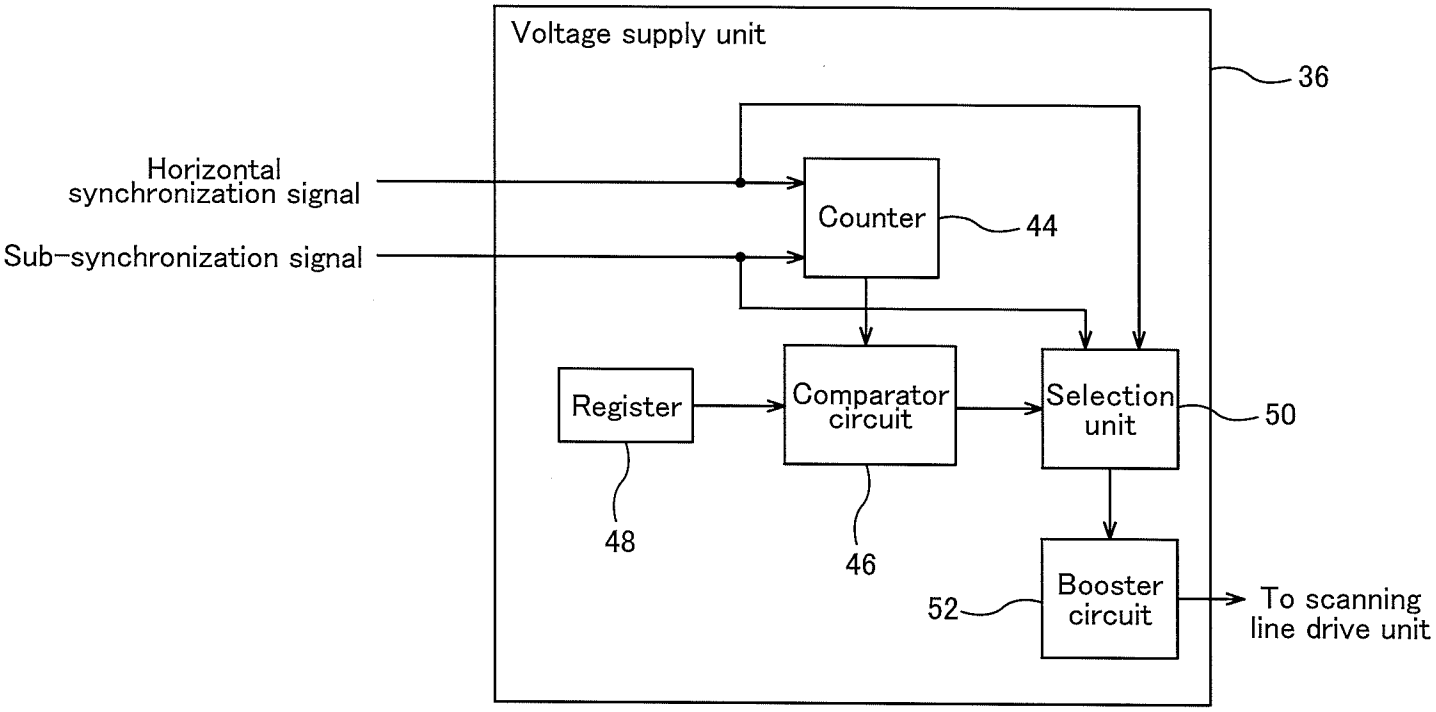
FIG. 3 is a block diagram for explaining a voltage supply unit.

As illustrated in FIG. 3, the counter 44 increments a counter value thereof every time when a reference synchronization signal is input, and resets the counter value every time when the horizontal synchronization signal is input. Here, the reference synchronization signal is a synchronization signal that the reference synchronization signal supply unit 38 (see FIG. 1) generates and outputs to the liquid crystal display device 10, which is a synchronization signal other than the horizontal synchronization signal and the vertical synchronization signal. In the present embodiment, the cycle of the reference synchronization signal is the same as that of the horizontal synchronization signal.

Figure 4:
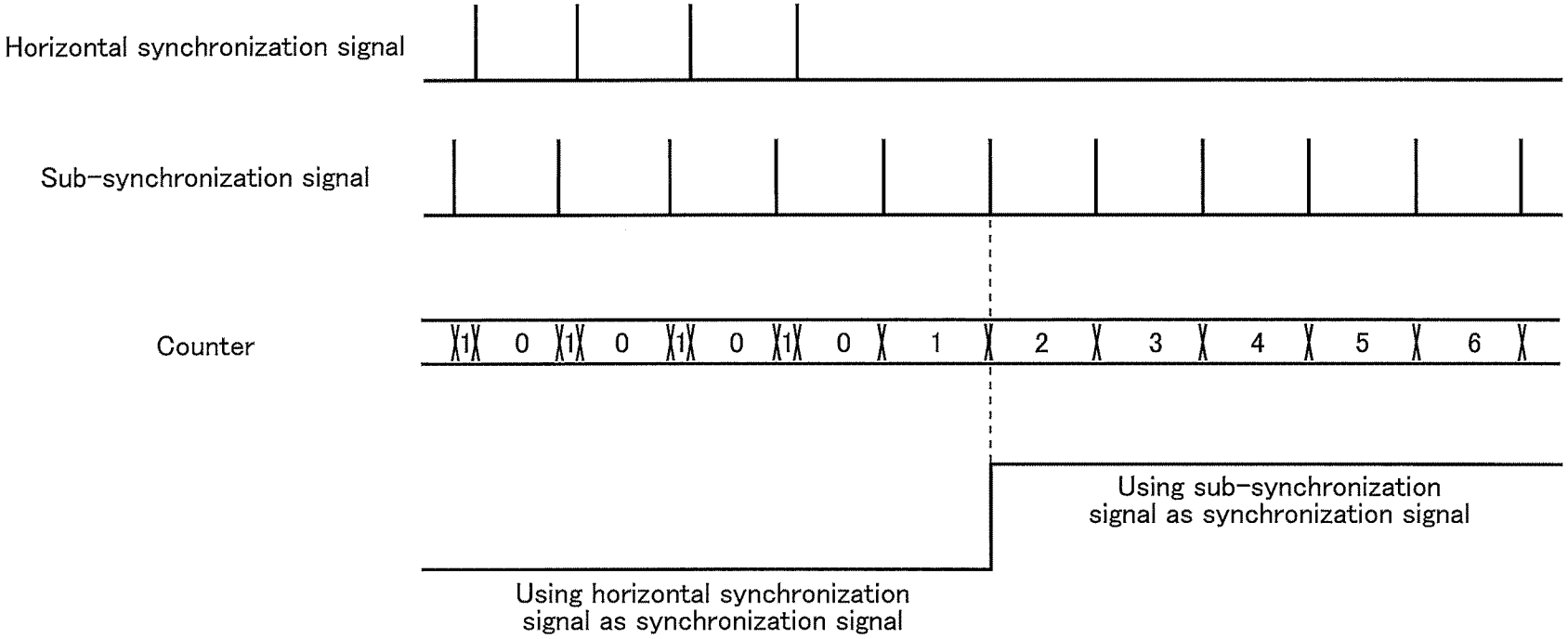
FIG. 4 is a time chart for explaining operations of a counter.

In the example illustrated in FIG. 4, the reference synchronization signal has the same cycle as that of the horizontal synchronization signal, but the input timings of these are different. The reference synchronization signal, however, may be input at the same timing as that of the horizontal synchronization signal.

The comparator circuit 46 reads out a reference counter value preliminarily stored in the register 48, and compares the reference counter value and the counter value of the counter 44. The value is arbitrary, though the reference counter value is 2 in the example illustrated in FIG. 4.

The selection unit 50 uses the horizontal synchronization signal as a synchronization signal when a driving voltage is generated, as illustrated in FIG. 4, in the case where the counter value is less than the reference counter value. The selection unit 50 uses the reference synchronization signal as a synchronization signal when a driving voltage is generated, as illustrated in FIG. 4, in the case where the counter value is equal to or more than the reference counter value.

The booster circuit 52 generates a driving voltage from the power source voltage in synchronization with a synchronization signal that the selection unit 50 selects. The driving voltage includes a selection voltage and a non-selection voltage. The selection voltage is output to, among the plurality of scanning lines GL, those selected by the scanning line drive unit 32. The non-selection voltage has a polarity opposite to that of the selection voltage.

Here, as illustrated in FIG. 1, the display signal supply unit 28 includes a pausing driving control unit 28A.

The pausing driving control unit 28A controls output of a display signal to the timing control unit 30 by the display signal supply unit 28. More specifically, the pausing driving control unit 28A alternately realizes a period while the output of a display signal to the timing control unit 30 by the display signal supply unit 28 is carried out, and a period while the output of a display signal to the timing control unit 30 by the display signal supply unit 28 is suspended.

As described above, based on the display signal sent from the display signal supply unit 28, the timing control unit 30 controls the scanning line drive unit 32 and the signal line drive unit 34. More specifically, based on the control signal sent from the timing control unit 30, the scanning line drive unit 32 selects and scans the plurality of scanning lines GL in order, so as to control the operations of the thin film transistors 20. Further, based on the control signal sent from the timing control unit 30, the signal line drive unit 34 outputs the signal voltage to each signal line SL. In other words, in the case where the display signal is input, the timing control unit 30 realizes a driving period in which control of the scanning line drive unit 32 based on the display signal is executed.

On the other hand, in the case where no display signal is sent from the display signal supply unit 28, the timing control unit 30 suspends the control of the scanning line drive unit 32 and the signal line drive unit 34 based on the display signal. In other words, in the case where no display signal is input, the timing control unit 30 realizes a pausing period in which the control of the scanning line drive unit 32 based on the display signal is suspended.

Figure 5:
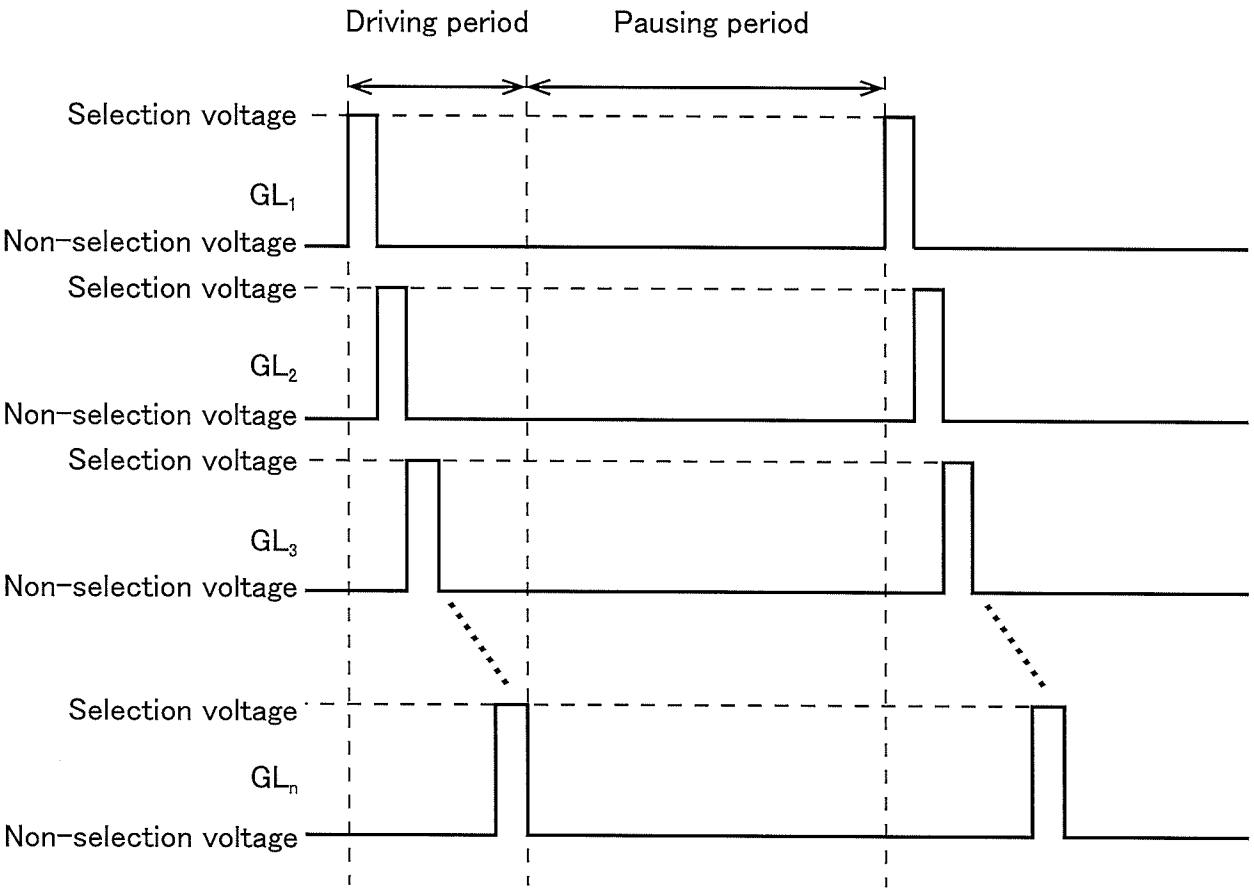
FIG. 5 is a time chart for explaining a driving period and a pausing period.

The following describes operations of the scanning line drive unit 32 during the driving period and the pausing period while referring to FIG. 5.

The scanning line drive unit 32 selects and scans the plurality of scanning line GL in order during the driving period. During a driving period, the scanning line drive unit 32 outputs the selection voltage and the non-selection voltage supplied from the voltage supply unit 36 to each scanning line GL. More specifically, the scanning line drive unit 32 outputs the selection voltage to selected one of the scanning lines GL, and outputs the non-selection voltage to non-selected ones of the scanning lines GL.

The scanning line drive unit 32 suspends selecting and scanning the plurality of scanning lines GL in order, during the pausing period. During the pausing period, the scanning line drive unit 32 outputs the non-selection voltage supplied from the voltage supply unit 36 (booster circuit 52) to the plurality of scanning lines GL.

The length of the pausing period may be equal to the length of the driving period, and preferably longer than the length of the driving period. In the case where the pausing period is longer than the driving period, electric power consumed by the display signal supply unit 28 can be reduced further. In the example illustrated in FIG. 5, the pausing period has a length twice the length of the driving period.

The following describes image display by the liquid crystal display device 10.

First, a case is described where a display signal is sent from the display signal supply unit 28 to the timing control unit 30, that is, a case where the output of a display signal by the display signal supply unit 28 is being executed. In this case, the timing control unit 30 controls the scanning line drive unit 32 and the signal line drive unit 34 based on the display signal sent from the display signal supply unit 28.

More specifically, the scanning line drive unit 32 selects and scans the plurality of scanning lines GL in order, based on the control signal sent from the timing control unit 30, so as to control operations of the thin film transistors 20. The signal line drive unit 34 outputs a signal voltage to each signal line SL, based on the control signal sent from the timing control unit 30. This allows charges corresponding to the signal voltage to be stored in the accumulation capacitor 26. Consequently, a desired image is displayed on the liquid crystal panel 12.

Next, a case is described where a display signal is not sent from the display signal supply unit 28 to the timing control unit 30, that is, a case where the output of a display signal by the display signal supply unit 28 is being suspended. In this case, the timing control unit 30 suspends the control of the scanning line drive unit 32 and the signal line drive unit 34 based on the display signal. In the liquid crystal display device 10, therefore, electric power consumption can be reduced.

Figure 6:
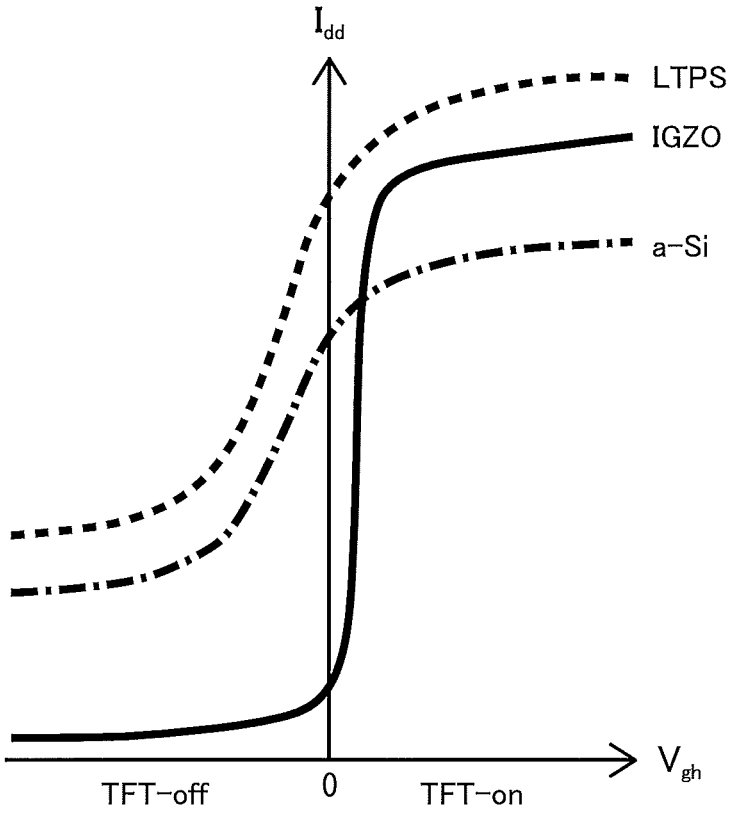
FIG. 6 is a graph showing operation properties of a thin film transistor.

Further, in the pausing period, the reference synchronization signal is input to the booster circuit 52. This causes a non-selection voltage supplied to the scanning line drive unit 32 during the pausing period to be generated. Here, the non-selection voltage has a polarity opposite to that of the selection voltage. As illustrated in FIG. 6, therefore, leakage current of the thin film transistor 20 can be reduced as compared with the case where the non-selection voltage is 0V. In the liquid crystal display device 10, deterioration of images during the pausing period, that is, deterioration of images due to leakage current of the thin film transistor 20 can be suppressed. Consequently, the display quality of the liquid crystal panel 12 can be secured.

In the present embodiment, the semiconductor layer of the thin film transistor 20 contains indium (In), gallium (Ga), zinc (Zn), and oxygen (O). As illustrated in FIG. 6, leakage current can be reduced as compared with the case where the semiconductor layer is made of amorphous silicon, or the case where the semiconductor layer is made of low-temperature polysilicon.

Further, during the driving period, the driving voltage is generated in synchronization with the horizontal synchronization signal. In the images displayed on the liquid crystal panel 12, therefore, noise becomes inconspicuous. Consequently, the display quality of the liquid crystal panel 12 can be secured.

The following description explains this in more detail. The driving voltage is generated from the power source voltage. Here, the power source voltage fluctuates, though slightly, in the same cycles as those of the horizontal synchronization signal. Therefore, if the driving voltage is generated by using the horizontal synchronization signal as a synchronization signal for boosting, the voltage comes to fluctuate in an interlocked manner with the liquid crystal driving action, which makes noises of images displayed on the liquid crystal panel 12 inconspicuous. Consequently, the display quality of the liquid crystal panel 12 can be secured.

On the other hand, during the pausing period, the non-selection voltage is generated in synchronization with the reference synchronization signal. Here, during the pausing period, the thin film transistor 20 may be turned off. Therefore, even if the cycle of the reference synchronization signal is deviated more or less with respect to the cycle of the horizontal synchronization signal, the deviation hardly influences the image display on the liquid crystal panel 12.

The Second Embodiment

Figure 7:
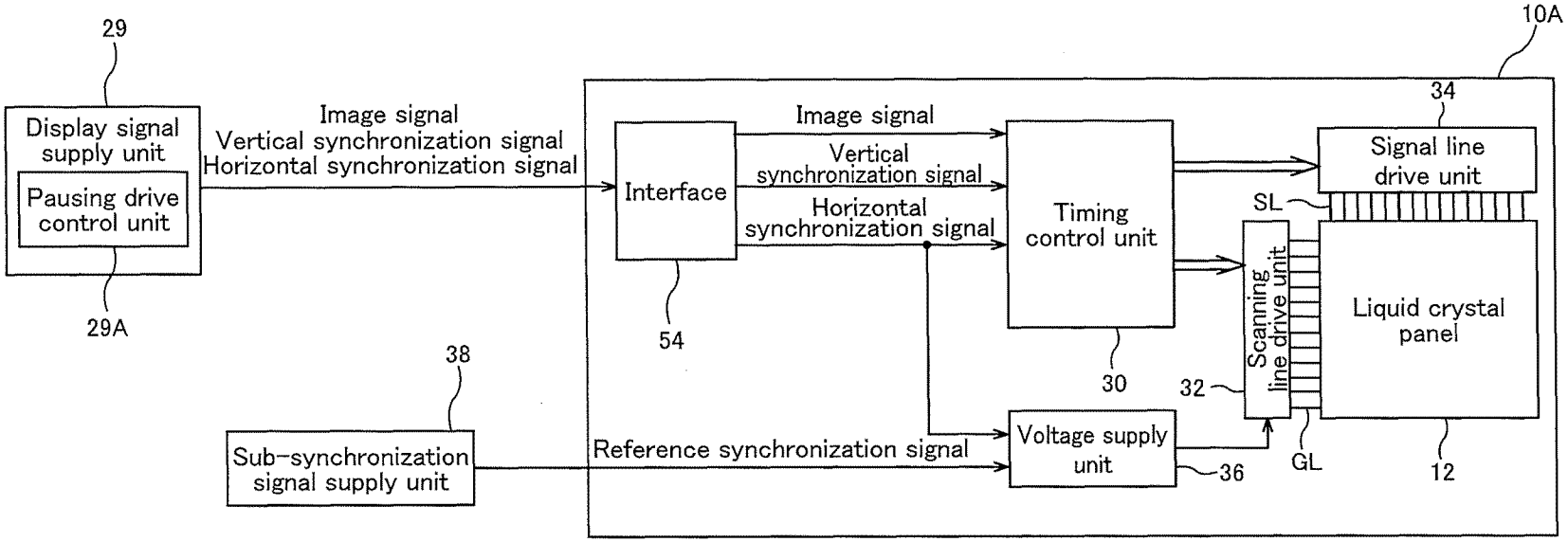
FIG. 7 is a block diagram for explaining a liquid crystal display device according to the Second Embodiment of the present invention.

The following describes a liquid crystal display device 10A according to the Second Embodiment of the present invention while referring to FIG. 7. In the example illustrated in FIG. 7, a display signal supply unit 29 outputs a display signal as a differential serial signal. The display signal supply unit 29 includes a pausing driving control unit 29A.

The pausing driving control unit 29A controls output of the display signal to the timing control unit 30 by the display signal supply unit 29. More specifically, the pausing driving control unit 29A alternately realizes a period while the output of a display signal to the timing control unit 30 by the display signal supply unit 29 is carried out, and a period while the output of a display signal to the timing control unit 30 by the display signal supply unit 29 is suspended.

In the example illustrated in FIG. 7, the liquid crystal display device further includes an interface 54. The interface 54 converts a differential serial signal (display signal) sent from the display signal supply unit 29 into a parallel signal, and outputs the same to the timing control unit 30.

In the liquid crystal display device 10A, the display signal supply unit 29 outputs the display signal as a differential serial signal. Therefore, as compared with the case where the display signal is output as a parallel signal, the display signal can be transferred at a high speed.

The Third Embodiment

Figure 8:
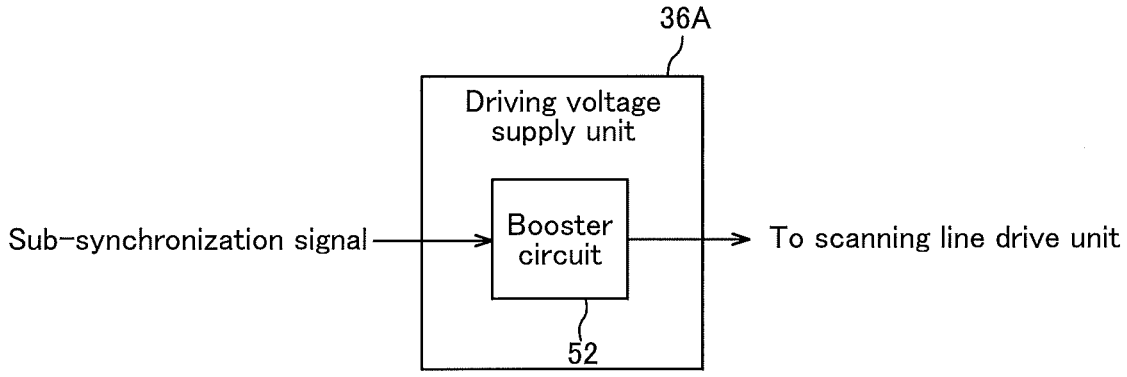
FIG. 8 is a block diagram for explaining a liquid crystal display device according to the Third Embodiment of the present invention.

The following describes a liquid crystal display device according to the Third Embodiment of the present invention while referring to FIG. 8. In the example illustrated in FIG. 8, as compared with the First Embodiment, the counter 44, the comparator circuit 46, the register 48 and the selection unit 50 are not included in a voltage supply unit 36A. To the booster circuit 52, neither of the horizontal synchronization signal and the vertical synchronization signal is input. In other words, only the reference synchronization signal is input to the booster circuit 52 as a synchronization signal. During the driving period, the booster circuit 52 generates the selection voltage and the non-selection voltage in synchronization with the reference synchronization signal. During the pausing period, the booster circuit 52 generates the non-selection voltage in synchronization with the reference synchronization signal.

In the Third Embodiment, the synchronization signal used when the selection voltage and the non-selection voltage are generated during the driving period and the synchronization signal used when the non-selection voltage is generated during the pausing period do not need to be made different from each other. Therefore, the configuration is made simpler, as compared with the case where the synchronization signal used when the selection voltage and the non-selection voltage are generated during the driving period, and the synchronization signal used when the non-selection voltage is generated during the pausing period are made different from each other.

The Fourth Embodiment

Figure 9:
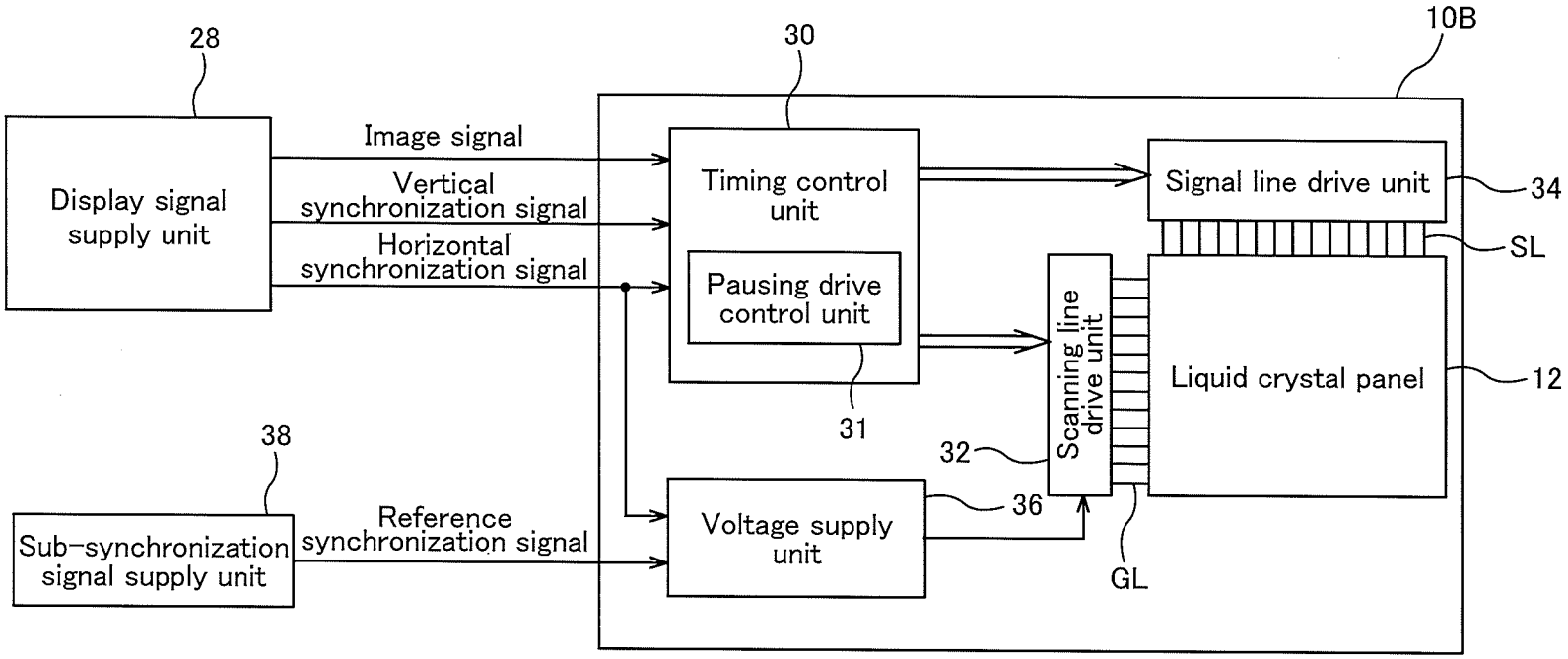
FIG. 9 is a block diagram for explaining a liquid crystal display device according to the Fourth Embodiment of the present invention.

The following describes a liquid crystal display device 10B according to the Fourth Embodiment of the present invention while referring to FIG. 9. In the liquid crystal display device 10B, as compared with the First Embodiment, the display signal supply unit 28 does not include the pausing driving control unit 28A, and instead, the timing control unit 30 includes the pausing driving control unit 31. The pausing driving control unit 31 alternately realizes a driving period while the control of the scanning line drive unit 32 and the signal line drive unit 34 based on the display signal is carried out, and a pausing period while the control of the scanning line drive unit 32 and signal line drive unit 34 based on the display signal is suspended. In other words, in the First Embodiment, the pausing period is realized when the timing control unit 30 does not receive a display signal, but in the present embodiment, the pausing period can be realized even if the timing control unit 30 receives a display signal. In the present embodiment as well, since the non-selection voltage supplied to the scanning line drive unit 32 is generated during the pausing period, deterioration of images during the pausing period, that is, deterioration of images due to leakage current of the thin film transistor 20 can be suppressed. Consequently, the display quality of the liquid crystal panel 12 can be secured.

The Fifth Embodiment

In the Second Embodiment, the display signal supply unit 29 does not have to include the pausing driving control unit 29A. Instead, the timing control unit 30 may include a pausing driving control unit, as is the case with the Fourth Embodiment. In other words, in the Second Embodiment, the pausing period is realized when the timing control unit 30 does not receive a display signal, but in the present embodiment, the pausing period can be realized even when the timing control unit 30 receives a display signal. In the present embodiment as well, since the non-selection voltage supplied to the scanning line drive unit 32 is generated during the pausing period, deterioration of images during the pausing period, that is, deterioration of images due to leakage current of the thin film transistor 20, can be suppressed. Consequently, the display quality of the liquid crystal panel 12 can be secured.

The Sixth Embodiment

In the First Embodiment, the display signal supply unit 28 does not have to include the pausing driving control unit 28A. In this case, the non-selection voltage can be generated even if any malfunctions occur to the output of the display signal by the display signal supply unit 28 which causes no display signal to be input to the timing control unit 30. Consequently, deterioration of images caused by the situation in which no display signal is input to the timing control unit 30, that is, deterioration of images due to leakage current of the thin film transistor 20, can be suppressed. Consequently, the display quality of the liquid crystal panel 12 can be secured.

The Seventh Embodiment

In the Second Embodiment, the display signal supply unit 29 does not have to include the pausing driving control unit 29A. In this case, the non-selection voltage can be generated even if any malfunctions occur to the output of the display signal in at least either one of the display signal supply unit 29 and the interface 46 which causes no display signal to be input to the timing control unit 30. Consequently, deterioration of images caused by the situation in which no display signal is input to the timing control unit 30, that is, deterioration of images due to leakage current of the thin film transistor 20, can be suppressed. Consequently, the display quality of the liquid crystal panel 12 can be secured.

In the above description, the embodiments of the present invention are described in detail, but these are merely examples, and the present invention is not limited at all by the above-mentioned embodiments.

The invention claimed is:

1. A liquid crystal display device comprising a liquid crystal panel and displaying images on the liquid crystal panel, wherein the liquid crystal panel includes:

a plurality of scanning lines;

a plurality of signal lines that intersect with the plurality of scanning lines; and thin film transistors provided at points of intersection of the plurality of scanning lines and the plurality of signal lines, respectively, and are connected to pixel electrodes, the liquid crystal display device further comprising:

a booster circuit that generates a driving voltage from a power source voltage;

a scanning line drive unit that selects the plurality of scanning lines in order and controls operations of the thin film transistors using the driving voltage generated by the booster circuit; and a timing control unit that controls the scanning line drive unit based on a display signal that includes a horizontal synchronization signal, a vertical synchronization signal, and an image signal, the timing control unit realizing a driving period while control of the scanning line drive unit based on the display signal is carried out, and a pausing period while control of the scanning line drive unit based on the display signal is suspended, wherein the driving voltage includes:

a selection voltage to be output to, among the plurality of scanning lines, one selected by the scanning line drive unit; and a non-selection voltage having a polarity opposite to that of the selection voltage, wherein, to the booster circuit, a reference synchronization signal is input, at least during the pausing period, wherein the booster circuit, during the pausing period, generates the non-selection voltage in synchronization with the reference synchronization signal, and wherein the scanning line drive unit, during the pausing period, outputs the non-selection voltage generated by the booster circuit to the plurality of scanning lines.

2. The liquid crystal display device according to claim 1, wherein, to the booster circuit, during the driving period, the horizontal synchronization signal is input, and the booster circuit, during the driving period, generates the selection voltage and the non-selection voltage in synchronization with the horizontal synchronization signal.

3. The liquid crystal display device according to claim 2, further comprising a counter that increments a counter value every time when the reference synchronization signal is input, and resets the counter value every time when the horizontal synchronization signal is input.

4. The liquid crystal display device according to claim 3, further comprising:

a register that stores a reference counter value that is preliminarily determined;

a comparator circuit that compares the counter value of the counter and the reference counter value; and a selection unit that outputs either one of the horizontal synchronization signal and the reference synchronization signal as a result of a selection based on a comparison by the comparator circuit.

5. The liquid crystal display device according to claim 1, wherein, to the booster circuit, the reference synchronization signal is input during each of the driving period and the pausing period, and the booster circuit, during the driving period, generates the selection voltage and the non-selection voltage in synchronization with the reference synchronization signal.

6. The liquid crystal display device according to claim 1, wherein the display signal sent thereto as a parallel signal is input to the timing control unit.

7. The liquid crystal display device according to claim 6, further comprising an interface that converts the display signal sent thereto as a differential serial signal into a parallel signal, and outputs the same to the timing control unit.

8. The liquid crystal display device according to claim 1, wherein the thin film transistor has a semiconductor layer made of an oxide semiconductor.

9. The liquid crystal display device according to claim 8, wherein the oxide semiconductor contains indium (In), gallium (Ga), zinc (Zn) and oxygen (O).

10. The liquid crystal display device according to claim 9, wherein the oxide semiconductor has crystallinity.

* * * * *